US006625402B2

(12) United States Patent
Takemoto

(10) Patent No.: US 6,625,402 B2
(45) Date of Patent: Sep. 23, 2003

(54) PRINTING SYSTEM, IMAGE FORMING CARTRIDGE, INFORMATION SERVICE SYSTEM, AND INFORMATION SERVICE SERVER

(75) Inventor: Hitoshi Takemoto, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 10/098,296

(22) Filed: Mar. 18, 2002

(65) Prior Publication Data

US 2002/0131784 A1 Sep. 19, 2002

(30) Foreign Application Priority Data

Mar. 19, 2001 (JP) ..... 2001-079096

(51) Int. Cl.[7] ..... G03G 15/00

(52) U.S. Cl. ..... 399/8; 399/12; 399/24; 399/25

(58) Field of Search ..... 399/1, 8, 12, 13, 399/24, 25, 27, 110, 111, 119

(56) References Cited

U.S. PATENT DOCUMENTS 5,132,729 A * 7/1992 Matsushita et al. ..... 399/24
5,835,817 A * 11/1998 Bullock et al. ..... 399/25
6,157,792 A * 12/2000 Mori et al. ..... 399/24
6,163,658 A 12/2000 Suzuki
6,188,851 B1 * 2/2001 Eom ..... 399/8
6,285,835 B1 * 9/2001 Guillemin et al. ..... 399/8
6,317,570 B1 * 11/2001 Uchida et al. ..... 399/8
6,529,692 B1 * 3/2003 Haines et al. ..... 399/27

FOREIGN PATENT DOCUMENTS

JP 9-190138 7/1997

* cited by examiner

*Primary Examiner*—Sandra Brase
(74) *Attorney, Agent, or Firm*—Foley & Lardner

(57) ABSTRACT

An information service server, which manages a home page that provides information about an image forming cartridge and a printing apparatus using the image forming cartridge, and a printing system are connected to each other via a network. The printing system includes an image forming cartridge having a nonvolatile memory that stores access information for gaining access to the home page and identification information for identifying the image forming cartridge, identifying means for identifying the image forming cartridge as a genuine product based on the identification information, and access means for gaining access to the home page based on the access information when the image forming cartridge is identified as a genuine product.

20 Claims, 4 Drawing Sheets

PRINTING SYSTEM, IMAGE FORMING CARTRIDGE, INFORMATION SERVICE SYSTEM, AND INFORMATION SERVICE SERVER

BACKGROUND OF THE INVENTION

1. Field of the Invention

The present invention relates to a printing system, an information service system, and an information service server. Particularly, the present invention relates to a printing system which, in order to form an image, uses an image forming cartridge attached to a printer to be exchangeable by a user as a consumable item and which incorporates a storage medium having a storage area where information is writable/readable thereto/therefrom. Furthermore, the present invention relates to an information service system and an information service server.

2. Description of the Related Art

Conventionally, on this kind of printing system, for example, as described in Japanese Patent Laid-Open No. 9-190138, there was mounted a storage medium having a storage area where arbitrary information, which a user inputted from a control panel with a display provided in the main body of an image forming apparatus, was writable and readable. Then, personal information of the user such as start time of use, owner's name, purpose of use and the like were stored in the storage medium. Moreover, by operating the control panel with a display, the content of information was outputted onto the display of the control panel with a display in the form of a character string or a numerical value. Still moreover, the user arbitrarily input/output control setting information of the image forming apparatus to/from the storage medium mounted on the image forming cartridge, and performed such control that the control condition of the apparatus was changed based on the control setting information when the image forming cartridge was attached.

However, in the conventional printing system, the user had to write information onto the storage medium by the input from the control panel with a display provided to the main body of the image forming apparatus and this required much time and effort.

While, in recent years, a printer manufacturer manages a home page that provides service of useful information for a print user on the Internet, the user gains access to the home page via the Internet so as to collect information for high quality printing.

However, in the information service using the home page, it takes much time and effort of the user to visit the home page and collect information, and recognition of a home page, which provides information for high quality printing, is low. Under the present situation, this information service does not always succeed.

SUMMARY OF THE INVENTION

Accordingly, an object of the present invention is to provide a printing system, which facilitates access to a home page that provides various useful information from a printer manufacturer to a user, who has purchased not only a printer but also a genuine product of a consumable item, an image forming cartridge, an information service system, and an information service server.

The printing system of the present invention includes an image forming cartridge having a nonvolatile memory that stores access information for gaining access to a home page, which provides information about an image forming cartridge and a printing apparatus using the image forming cartridge, and identification information for identifying the image forming cartridge; identifying means for identifying the image forming cartridge as a genuine product based on the identification information; and access means for gaining access to the home page, which is connected to an information service server that manages the home page via a network based on the access information when the image forming cartridge is identified as a genuine product.

According to the present invention, it is possible for a user, who has purchased a genuine product, to gain access to the home page, which provides service of useful information, easily without having to perform complicated operations loaded so far.

Moreover, control information for high-quality printing with an image forming cartridge of a genuine product can be distributed to the printing system. Accordingly, it is possible to reduce the amount of processing such as complaints from users and the like.

Still moreover, the home page, which provides service of useful information, can be widely known to the users.

DETAILED DESCRIPTION OF THE PREFERRED EMBODIMENTS

A specific explanation will be next given of an embodiment of a printing system of the present invention and that of an information service system using this printing system with reference to the drawings accompanying herewith.

Figure 1:
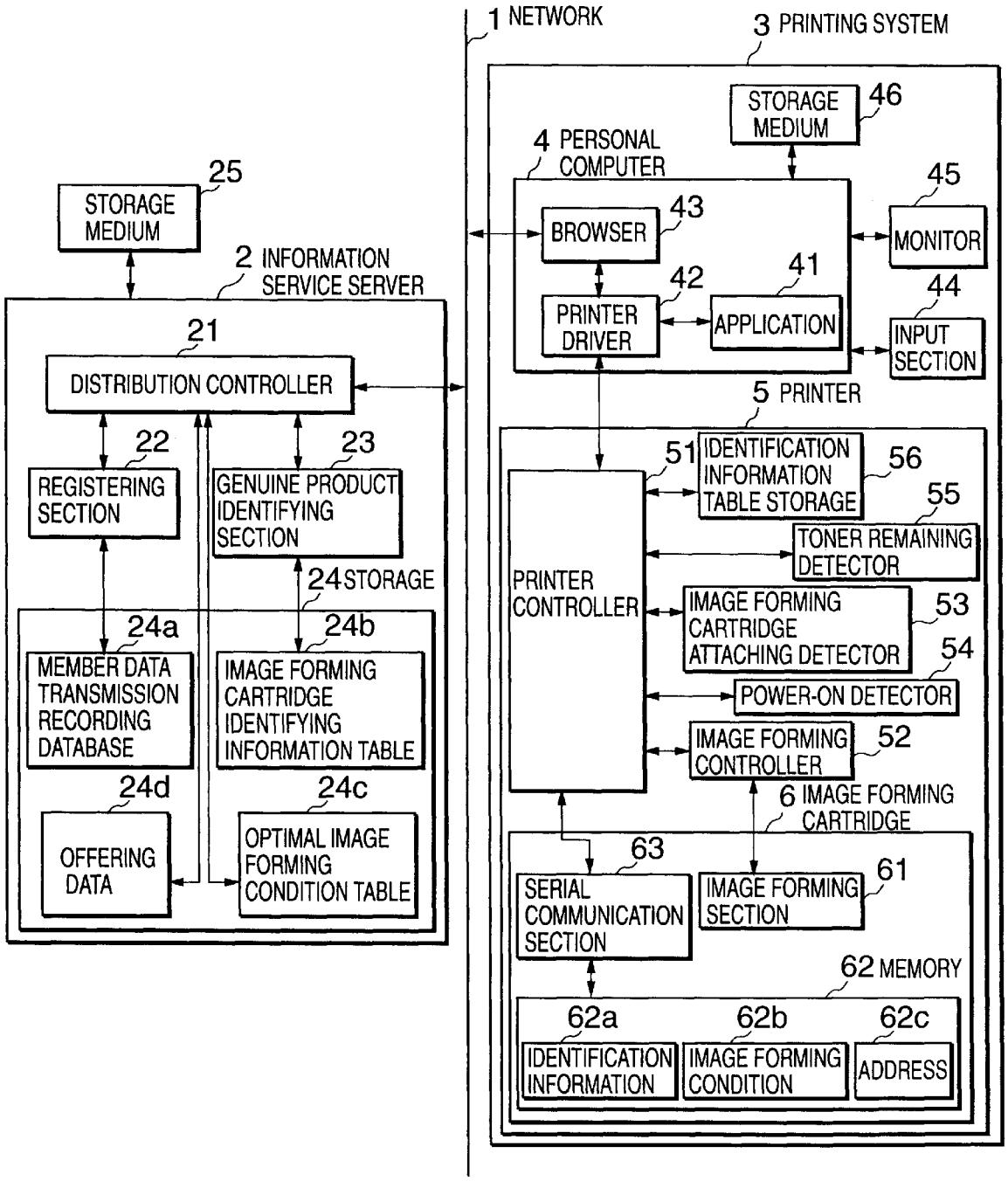
FIG. 1 is a block diagram illustrating a structure of one embodiment of the present invention.

FIG. 1 is a block diagram illustrating a structure of the entire information service system using the printing system of the present invention.

The information service system of FIG. 1 includes an information service server 2, which manages an information service site of a printer manufacturer on a network 1 such as the Internet and the like, and a printing system 3, which is connected to the information service server 2 via the network 1.

The information service site of the printer manufacturer provides information about a printer, which the printer manufacturer sells, and an image forming cartridge, which is attached to the printer to be exchangeable by a user and which is used to form an image. For example, the information service site provides information about an electro-photographic printer, which the printer manufacturer sells, and an EP (electro-photographic) cartridge used in such a printer. Moreover, a home page of the information service site has menus to perform, for example, user registration service, offering of an optimal process condition, which is necessary when printing is performed using EP cartridge, download service of the latest printer driver, download service of a print application, download service of other game software and various kinds of applications, and information service relating to life, hobbies and the like.

The printing system 3 is a system in which, for example, a personal computer 4 and an electro-photographic printer 5 are connected to each other on a one-to-one standalone basis using an IEEE1284 two-way parallel interface.

The personal computer 4 includes an application 41 for generating document data and for providing an instruction to print in accordance with user's operation, a printer driver 42 for requesting a printer status of printer 5 and for generating printing data from document data instructed to print from the application 41, and a browser 43, which gains access to the information service server 2 that manages the home page of the information service site via network 1 in response to the instruction from the printer driver 42 to request distribution of information and which receives information distributed. Moreover, an input section 44 such as a keyboard and a mouse that are operated by the user, and a monitor 45 are connected to the personal computer 4.

In response to the user's operation, the personal computer 1 transmits printing data, which is generated by the printer driver 42 in connection with document data instructed to print, to the printer 5 via an IEEE 1284 two-way parallel I/F cable (not shown). A printer controller 51 of the printer 5 processes and expands received printing data, and executes an electro-photographic process through an image forming cartridge 6 built in the printer 5, for example, an image forming section 61 of an EP cartridge so as to output data onto printing paper. The image forming section 61 includes, for example, a photosensitive drum for forming an electrostatic latent image when its surface is uniformly charged and then scanned with an optical beam, a charger for charging the photosensitive drum, and a developing device for developing the electrostatic latent image with toner, and the like.

Note that, at this time, an image forming controller 52 of the printer 5 controls the image forming section 61 of the EP cartridge such that the electro-photographic process reaches an optimal condition. For example, an optimal grid voltage is provided to the charger according to an optical response (sensitivity) of the photosensitive drum of the EP cartridge, an optimal bias voltage is applied to the developing device, and the photosensitive drum is irradiated with the optical beams of an optimal quantity.

Moreover, the printer 5 includes an image forming cartridge attaching detector 53 for detecting that a new image forming cartridge is attached, a power-on detector 54 for detecting power-on of the printer 5, and a toner remaining detector 55 for detecting the remaining quantity of toner of the image forming cartridge 6.

The image forming cartridge 6 includes a memory 62 that stores identification information of the image forming cartridge 6. The memory 62 is, for example, EEPROM in which the content can be electrically rewritten and erased, or a flush memory, and coded identification information 62*a* of the image forming cartridge 6, an image forming condition 62*b* for obtaining an optimal printing result using the image forming cartridge 6 and a home page address 62*c* of an information service site are stored therein at the time of factory shipment.

Note that the identification information 62*a* of an image forming cartridge 6 may include 8-bit identification number, which are divided into manufacturer's serial number (3 bits), date of manufacture (2 bits), manufacturing factory (1 bit), and authentication number (2 bits) in order of precedence. Moreover, the total number of printed paper is recorded on the identification information 62*a* of the memory 62, and it is desirable that the printer controller 51 counts the number of printed paper for each printing job so as to add the total number of printed paper.

Moreover, for example, in the case of the EP cartridge, the image forming condition 62*b* includes 8-bit data representing a lot number, an optimal grid voltage (KV), which is responsive to the optical response (sensitivity) of the photosensitive drum of the EP cartridge against light irradiation, a bias voltage (KV), and an emission quantity (mW) of a light source that generates optical beams. The image forming condition 62*b* also includes information for setting a process condition, which differs according to the total number of printed paper of identification information 62*a*. It is desirable that the printer controller 51 reads the total number of printed paper of the identification information 62*a* to perform printing under an optimal condition that adds it at the time of printing. Furthermore, for example, in the case of electro-photographic printer, the image forming controller 52 of the printer 5 controls the optimal grid voltage (KV), bias voltage (KV), and emission quantity (mW) of the light source, which are responsive to the optical response (sensitivity) of the photosensitive drum of the EP cartridge against light irradiation, in accordance with the image forming condition 62*b* recorded in the memory 62 of the image forming cartridge 6.

The memory 62 of the image forming cartridge 6 is, for example, connected to the printer controller 51 of the printer 5 through a serial communication section 63 provided in the image forming cartridge 6 by use of a serial communication interface with four signals of 1pin-S. GND, 2pin-clock, 3pin-Data, and 4pin-F.GND.

Moreover, the image forming cartridge 6 is connected to the printer 5 by a connector (not shown) of the serial communication interface when being attached to the printer 5. Note that the connection of the serial communication interface connector may be automatically made by attaching the image forming cartridge 6 to the printer 5. There is a possibility that a communication error will occur due to toner, paper powder, dust and the like in the communication interface using infrared rays, optical communication, and the like. However, such a problem does not occur in this embodiment since connection is mechanically made by the connector of the serial communication interface. Furthermore, unlike the communication interface in which several tens of address buses and data buses are connected by the connector, an erroneous insertion and a poor connection are not apt to occur and an increase in the size of the connector can be prevented.

The printer 5 further includes an identification information table storage 56, which stores an identification information table indicating the range of manufacturer's serial number (3 bits), date of manufacture (2 bits), manufacturing factory (1 bit), and authentication number (2 bits), a guaranteed number of paper to be printed in connection with the printer 5 and the image forming cartridge 6, and the range of recognition as a genuine product from the relationship between the amount of toner remaining and the number of printed paper. The identification information table storage 56 is, for example, EEPROM in which the content can be electrically rewritten and erased, or a flush memory.

When power of the printer 5 is turned on and a request for printer status is sent from the printer driver 42, the printer controller 51 reads the identification information 62*a* and the image forming condition 62*b* written in the memory 62 by performing two-way serial data communication using the serial communication I/F connector (not shown) via a serial communication circuit 63. Then, with reference to the identification information table, the printer controller 51 determines whether or not the identification information 62*a* is in the range of recognition as a genuine product, whether or not the total number of printed paper is one that exceeds the life of apparatus and the number of the guaranteed number of printed paper and whether or not the remaining quantity of toner differs obviously from the relationship with the number of printed paper, so that the image forming cartridge 6 is determined as a genuine product.

Furthermore, when the printer driver 42 identifies the image forming cartridge 6 as a genuine product, the browser 43 is started and gains access to the information service server 2 via the network 1 based on the home page address 62*c* stored in the memory 62.

This makes it possible to automatically view information, which is useful to the user, from the home page of the printer manufacturer without bothering the user with burdensome. Moreover, it is possible for the user to receive the service by selecting a desired service.

At this time, the printer driver 42 transmits the identification information 62*a* of the image forming cartridge 6, and requests an optimal image forming condition 62*b*, which is conformable to the image forming cartridge 6, from the information service server 2.

The information service server 2 includes a genuine product identifying section 23 for determining whether or not the image forming cartridge 6 is a genuine product based on the received identification information 62*a* of the image forming cartridge 6, and a distribution controller 21 for distributing an optimal image forming condition 62*b*, which is conformable to the identification information 62*a* of the image forming cartridge 6, based on an image forming condition table 24*c* stored in the storage 24 when the image forming cartridge 6 is determined as an genuine product by the genuine product identifying section 23.

When the optimal image forming condition 62*b* is distributed, the printer controller 51 rewrites the content of the image forming condition 62*b* stored in the memory 62, which is built in the image forming cartridge 6, to the image forming condition 62*b* collected from the home page.

This makes it possible to perform printing under an optimal image forming condition, which is conformable to the image forming cartridge 6 in use, without bothering the user with burdensome.

There is a case in which the printer controller 51 identifies the image forming cartridge 6 as a non-genuine product with reference to the identification information table even though the identification information 62*a* of image forming cartridge 6 can be obtained when power of the printer 5 is turned on and a request for printer status is sent from the printer driver 42. In this case, the printer controller 51 determines that the identification information table stored in the printer 5 is old and gains access to the information service server 2 via the network 1 based on the home page address 62*c* stored in the identification information table memory 62, and requests an optimal image forming condition 62*b* and an identification information table 24*b*.

When the genuine product identifying section 23 identifies the image forming cartridge 6 as a genuine product based on the identification, information 62*a* of the image forming cartridge 6, the distribution controller 21 of the information service server 2 distributes an optimal image forming condition, which is conformable to the identification information 62*a* of the image forming cartridge 6, based on the image forming condition table 24*c*. The distribution controller 21 also distributes the identification information table 24*b*, which has been used to determine a genuine product, to the printer driver 42.

The printer controller 51 rewrites the content of the identification information table storage 56 to a new identification information table 24*b* collected from the home page. This makes it possible to automatically change the identification information table 24*b* even if the identification information table 24*b* is changed after purchasing the printer 5.

Moreover, when the image forming cartridge 6 is identified as a genuine product by the genuine product identifying section 23, the information service server 2 checks whether or not user identification information received with the identification information 62*a* of the image forming cartridge 6 is registered as a member. When member registration is not carried out, the distribution controller 21 requests transmission of data for member registration from the printing system 3.

The printer driver 42 of the printing system 3 collects personal information including the user's name, address, E-mail address, and account information for charging as data for member registration with the approval of the user, and sends it back to the information service server 2. Subsequently, a registering section 22 of the information service server 2 performs processing for registering personal information to a member data transmission recording database 24*a*. This makes it possible to carry out member registration for receiving information service easily.

In a case where a planned change in the home page address is present in offering data 24*d* and the genuine product identifying section 23 identifies the image forming cartridge 6 as a genuine product, the information service server 2 transmits a changing time and a changed address together with an optimal image forming condition.

When receiving the changing time and the changed address, the printer controller 51 changes a home page address 62*c* stored in the memory 6 based on the changed address according to the changing time. This makes it possible to automatically gain access to the home page whose address is changed even if the home page address is changed after purchasing the image forming cartridge 6.

Note that, in a case where the genuine product identifying section 23 checks the received identification information 62*a* of the image forming cartridge 6 and identifies the image forming cartridge 6 as a non-genuine product, the information service server 2 records transmission on the member data transmission recording database 24*a* as presence of a charge for information service. While, in a case where the genuine product identifying section 23 identifies the image forming cartridge 6 as a genuine product, the information service server 2 records transmission thereon as absence of a charge for information service or presence of a reduced charge.

Note that the above has explained that the printing system 3 is a system in which the personal computer 4 and the printer 5 are connected to each other on a one-to-one standalone basis. However, such a system that the personal computer 4 and the printer 5 are connected to each other via the network such as intracompany LAN and the like using the Ethernet may be possible.

Note that the information service server 2 and the personal computer 4 are computers. The personal computer 4 reads a program stored in a storage medium 46, and performs operations to be explained as operations of the respective parts of the personal computer 4 based on the program. The information service server 2 may also read a program stored in a storage medium 25 and perform operations to be explained as operations of the respective parts of information service server 2 based on the program.

A specific explanation will be next given of the operations of this embodiment with reference to the drawings.

Figure 2:
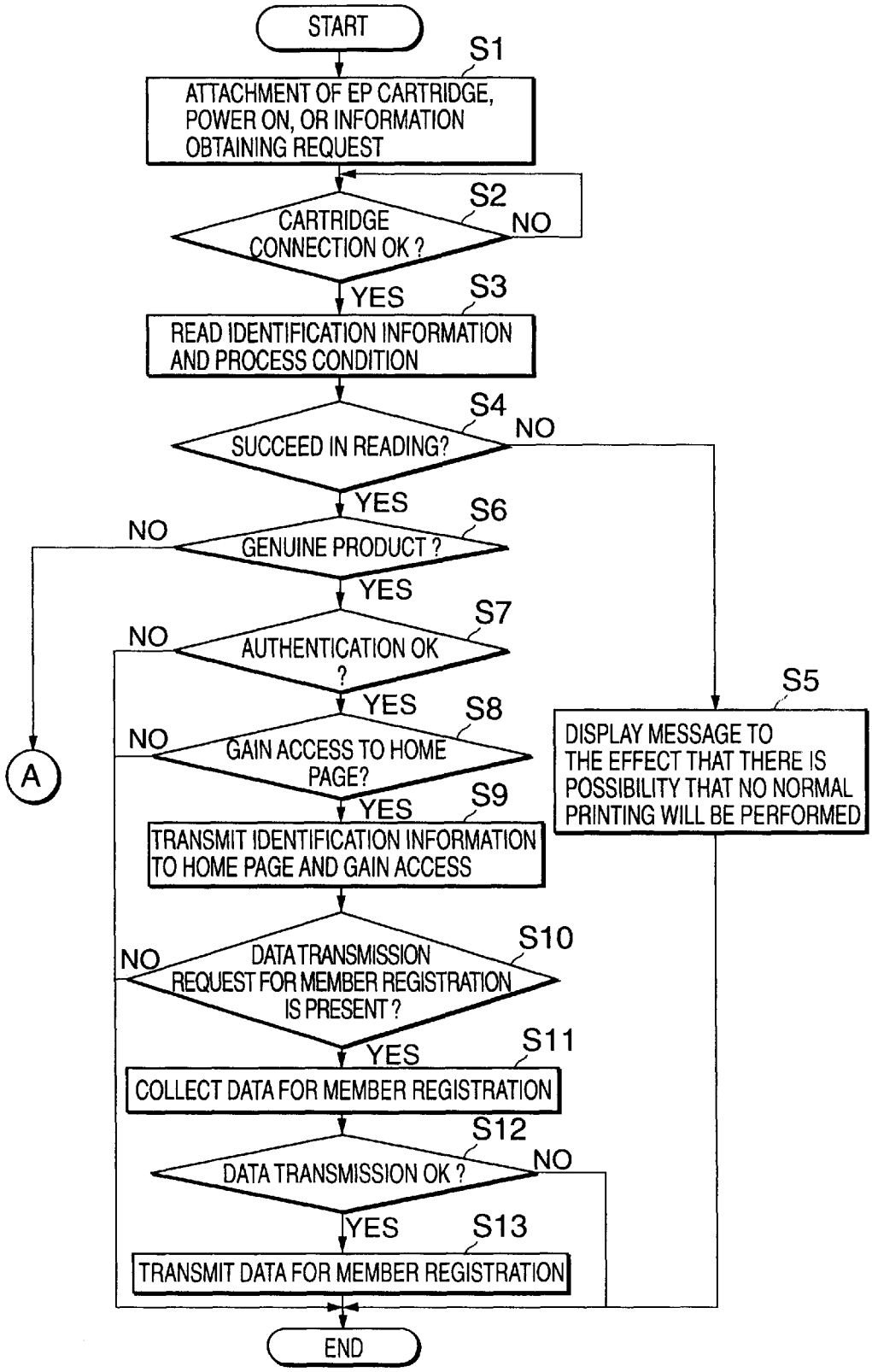
FIG. 2 is a view illustrating operations of a first embodiment of the present invention.

FIG. 2 is a flowchart illustrating the operations of the printing system 3 of FIG. 1, which are performed when the printer controller 51 of FIG. 1 determines that the image forming cartridge 6 is a genuine product.

The printer controller 51 turns on power of the printer 5, detects the attachment of a new image forming cartridge 6, and the printer driver 42 is requested to offer information service from the input section 44 of the user (step S1). At this time, the printer controller 51 checks the presence or absence of a connection error between the serial communication section 63 and the printer controller 51 (whether or not the connection of the connector is established) (step S2). At this time, if there is a connection error, the printer controller 51 displays a message to the effect that the connection error is present on the monitor 45, and continues the notification for a predetermined time while repeating the check. Then, if the connection error is unchanged, the printer controller 51 ends the processing. If the connection error is eliminated within the predetermined time, the printer controller 51 reads the identification information 62*a* and the image forming condition 62*b* of the image forming cartridge 6 stored in the memory 62 of the image forming cartridge 6 (step S3), and determines whether the reading is successful or not (step S4). If the reading is not successful, the printer controller 51 transmits a notification of cartridge abnormality to the personal computer 4 through IEEE 1284 two-way parallel I/F. Then, the personal computer 1 displays a message "normal printing cannot be performed in some cases" to the user through the monitor 45 and sends the user a warning that there is a possibility that a normal printing will not be performed when the printing is carried out with this cartridge (step S5), so that the replacement with a normal cartridge and a cartridge of a genuine product is urged and the processing is ended.

If the reading is successful, the printer controller 51 determines whether or not the identification information 62*a* is in the range of recognition as a genuine product, whether or not the total number of printed paper is one that exceeds the life of apparatus and the number of the guaranteed number of printed paper, and whether or not the remaining quantity of toner differs obviously from the relationship with the number of printed paper with reference to the identification information table storage 56, thereby determining whether the image forming cartridge 6 is a genuine product or not (step S6). When the image forming cartridge 6 is determined as a genuine product, the printer controller 51 authenticates that the corresponding user is a formal user via two-way communication between the printer and the personal computer (step S7). In the case where authentication is obtained, the printer controller 51 obtains the access information 62*c* of the information service site such as address, password, ID number and the like from the memory 62 of the image forming cartridge 6, and displays them on the monitor 45. Then, when the operation, which indicates acceptance, is carried out by the user, the printer controller 51 displays a message to the effect that the printer controller 51 gains access to the information service site based on displayed information such as address, password, ID number and the like (step S8). When the operation, which indicates acceptance, is not carried out by the user within a predetermined time, the printer controller 51 ends the processing. While, when the operation, which indicates acceptance, is carried out by the user within the predetermined time, the printer controller 51 immediately gains access to the information service site based on information such as address, password, ID number and the like (step S9).

Figure 3:
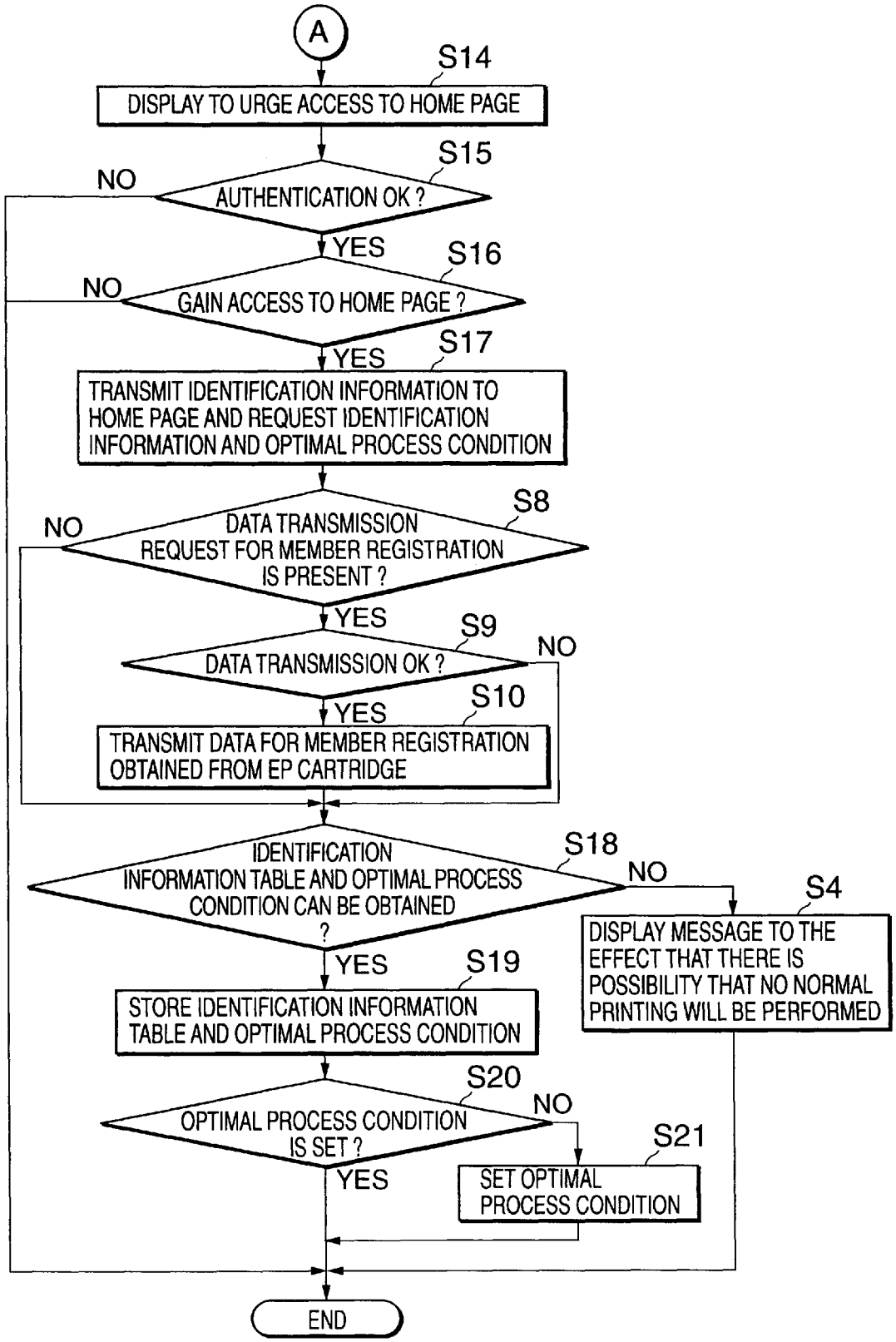
FIG. 3 is a block diagram illustrating a structure of one embodiment of the present invention.

FIG. 3 is a flowchart illustrating the operations of the printing system 3 of FIG. 1, which are performed when the printer controller 51 of FIG. 1 determines that the image forming cartridge 6 is not a genuine product even though the identification information 62*a* and the image forming condition 62*b* of the image forming cartridge 6 are read from the memory 62 of the image forming cartridge 6.

When it is determined that the image forming cartridge 6 is not a genuine product, the personal computer 4 displays a message, which urges the user to gain access to the home page of the printer manufacturer, on the monitor 45 (step S14). Next, the printer controller 51 authenticates that the corresponding user is a formal user via two-way communication between the printer and the personal computer (step S15). In a case where authentication is obtained, the printer controller 51 obtains the address, the password, the ID number and the like from the memory 62 of the image forming cartridge 6 and displays them on the monitor 45. Then, when the operation, which indicates acceptance, is carried out by the user, the printer controller 51 displays a message to the effect that the printer controller 51 gains access to the information service site based on displayed information such as address, password, ID number and the like (step S16). When the operation, which indicates acceptance, is not carried out by the user within a predetermined time, the printer controller 51 ends the processing. While, when the operation, which indicates acceptance, is carried out by the user within the predetermined time, the printer controller 51 immediately gains access to the information service site based on information such as address, password, ID number and the like, and requests the optimal image forming condition and the identification information table 24*b* (step S17).

Figure 4:
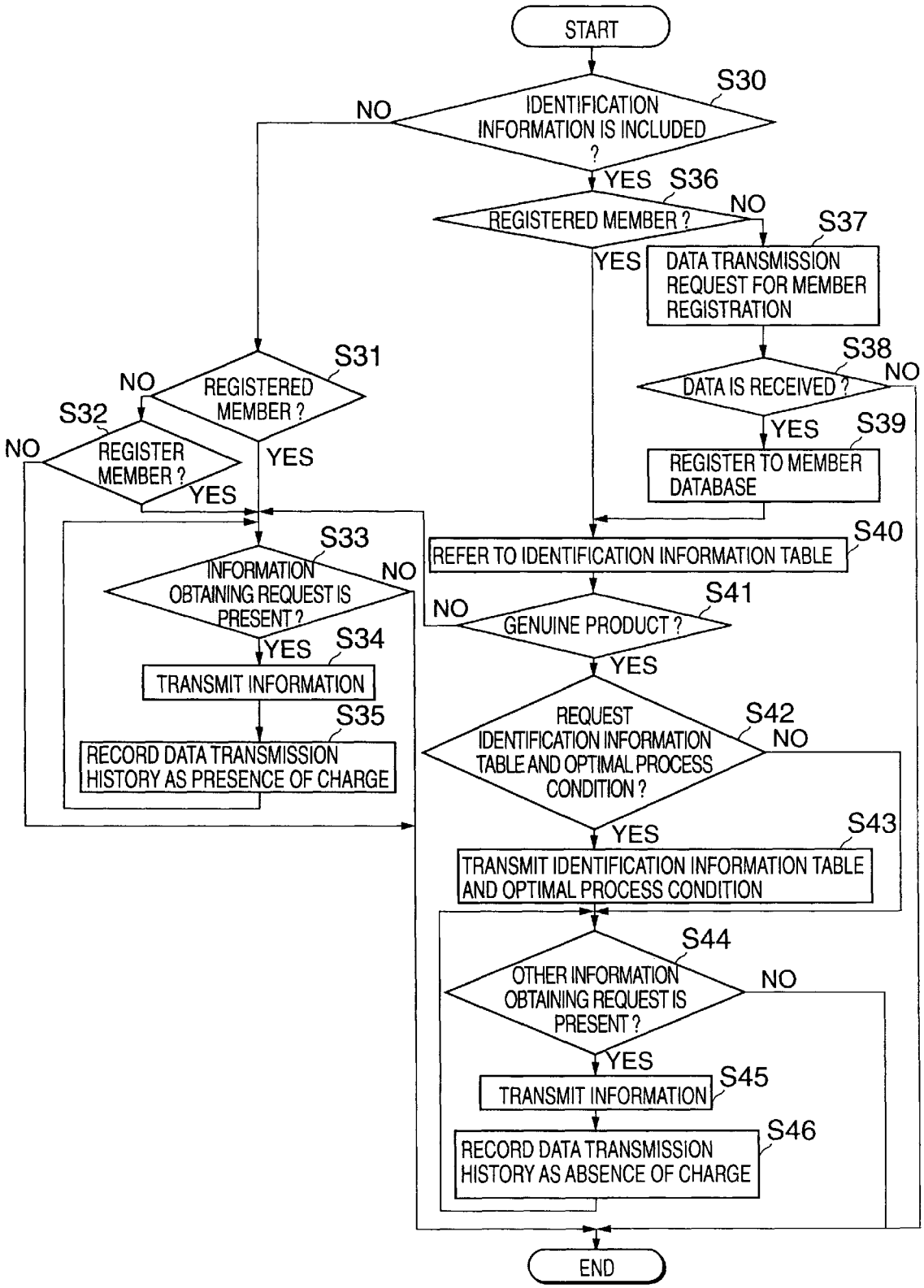
FIG. 4 is a view illustrating operations of the first embodiment of the present invention.

FIG. 4 is a flowchart illustrating the operations of the information service server 2 of FIG. 1.

When there is access to the home page of the information service site, the information service server 2 checks whether or not the identification information 62*a* of the image forming cartridge 6 is included (step S30). If no identification information 62*a* is included, the information service server 2 determines whether or not the corresponding user is a registered member (step S31). Then, if the corresponding user is not a registered member, the information service server 2 inquires of the user whether or not the user wishes to register (step S32). If member registration is made, the information service server 2 determines whether or not there is an information obtaining request (step S33). If there is no information obtaining request, the information service server 2 ends the processing. While, if there is an information obtaining request, the information service server 2 transmits requested information among the offering data 24*d* stored in the storage 24 in accordance with the menu selected by the user (step S34). Then, the information service server 2 records transmission on the member data transmission recording database 24*a* as presence of a charge for information service (step S35).

If identification information 62*a* of the image forming cartridge 6 is included, the information service server 2 checks whether or not the corresponding user is a registered member (step S36). Then, if the corresponding user is not a registered member, the information service server 2 requests data for registration (step S37). When the printing system 3 is requested to send data for registration via the network 1 (step S10), the printer driver 42 collects personal information including the user's name, address, E-mail address, and account information for charging as data for member registration stored in the personal computer 1 to be used in user authentication as illustrated in FIGS. 2 and 3 (step S11). Next, the printer driver 42 displays a message whether or not the information may be transmitted to perform the member registration on the monitor and inquires of the user about this point (step S12). If approval is input by the user, the printer driver 42 transmits such data to the information service server 2 (step S13).

When data for registration is transmitted to the information service server 2 (step S38), the registering section 22 of the information service server 2 performs processing for registering personal information registration to the member data transmission recording database 24*a* (step S39) as illustrated in FIG. 4.

Sequentially, the genuine product identifying section 23 refers to the identification information table 24*b* (step S40) and checks whether or not the received image forming cartridge 6 is a genuine product (step S41). In a case where the image forming cartridge 6 is determined as a genuine product, the genuine product identifying section 23 determines whether or not the identification information table 24*b* is requested (step S42). If the identification information table 24*b* is requested, the distribution controller 21 distributes an optimal image forming condition, which is conformable to the identification information 62*a* of the image forming cartridge 6, based on the image forming condition table 24*c*. Then, the distribution controller 21 also distributes a new identification information table 24*b*, which is conformable to the identification information 62*a* of the image forming cartridge 6, to the printing system 3 (step S43). At this time, if a planned change in the home page address is present therein, the distribution controller 21 distributes a changing time and a changed address to the printing system 3. Note that, in a case where the image forming cartridge 6 is not a genuine product, processing goes to step S33 and information service is performed on the precondition that a charge for the service is required.

On the other hand, as illustrated in FIG. 3, the printer controller 51 determines whether or not the printer driver 42 receives a new identification information table 24*b* via the browser 43 (step S18). In a case where the printer driver 42 receives the new identification information table 24*b*, the printer controller 51 stores it (step S19). Moreover, the printer controller 51 compares the received optimal image forming condition with the image forming condition stored in the memory 62, and determines whether or not the received optimal image forming condition is set to an optimal image forming condition (step S20). In a case where it is not set to an optimal image forming condition, the printer controller 51 sets it to an optimal image forming condition (step S21).

Furthermore, in a case where the changing time and the changed address are distributed, the printer controller 51 rewrites the address separately recorded on the memory 61 of the image forming cartridge 6 to a collected address in accordance with the changing time.

Back to FIG. 4, the distribution controller 21 determines whether or not there is an information obtaining request (step S44). If there is no request, the distribution controller 21 ends the processing. If there is the information obtaining request, the distribution controller 21 transmits the requested information among the offering data 24*d* stored in the storage 24 in accordance with the menu selected by the user (step S45). Then, the distribution controller 21 records transmission on the member data transmission recording database 24*a* as absence of a charge for information service or presence of a reduced charge (step S46).

As explained above, according to the present invention, it is possible for a user, who has purchased a genuine product, to gain access to the home page, which provides service of useful information, easily without having to perform complicated operations loaded so far.

Moreover, control information for high-quality printing with an image forming cartridge of a genuine product can be distributed to the printing system. Accordingly, it is possible to reduce the amount of processing such as complaints from users and the like.

Still moreover, the home page, which provides service of useful information, can be widely known to the users.

What is claimed is:

1. A printing system comprising:

an image forming cartridge having a nonvolatile memory that stores access information for gaining access to a home page, which provides information about an image forming cartridge and a printing apparatus using said image forming cartridge, and identification information for identifying said image forming cartridge;

identifying means for identifying said image forming cartridge as a genuine product based on said identification information; and access means, which is connected to an information service server that manages the home page via a network, for gaining access to the home page based on the access information when said image forming cartridge is identified as a genuine product.

2. The printing system according to claim 1, further comprising an identification information table storage for storing an identification information table indicating the range of recognition as a genuine product in connection with manufacturer's serial number, date of manufacture, manufacturing factory, and authentication code to determine whether or not the image forming cartridge is a genuine product.

3. The printing system according to claim 2, wherein when said identifying means identifies said image forming cartridge as a non-genuine product even though the identification information is read from said image forming cartridge, said access means transmits identification information of said image forming cartridge to gain access to the home page, and requests the identification information table, which is conformable to the identification information of said image forming cartridge, from the information service server.

4. The printing system according to claim 1, wherein when said image forming cartridge is identified as a genuine product, said access means collects information of a planned change in the access information from the home page, and said identifying means changes the access information of said memory based on the information of the planned change.

5. The printing system according to claim 1, wherein said nonvolatile memory further stores an image forming condition, said access means transmits identification information of said image forming cartridge and gains access to the home page, and requests an optimal image forming condition, which is conformable to identification information of said image forming cartridge, from the information service server, and when said access means collects an image forming condition from the home page, said identifying means rewrites a content of the image forming condition stored in the memory built in said image forming cartridge to the image forming condition.

6. The printing system according to claim 1, further comprising inquiring means for inquiring of the user whether or not access to the home page may be approved, and said access means gains access to the home page when user's approval is obtained.

7. The printing system according to claim 1, further comprising warning means for warning that there is a possibility that normal printing will not be carried out when said identifying means cannot read the identification information from said image forming cartridge.

8. The printing system according to claim 1, wherein when said access means is requested to transmit data for member registration from the home page, said access means transmits the data for member registration.

9. An image forming cartridge having a nonvolatile memory that stores access information for gaining access to a home page, which provides information about an image forming cartridge and a printing apparatus using an image forming cartridge, and identification information for identifying said image forming cartridge.

10. The image forming cartridge according to claim 9, wherein said image forming cartridge has a serial communication section that connects said nonvolatile memory and said identifying means to each other using a serial communication interface.

11. The image forming cartridge according to claim 9, wherein said image forming cartridge has a connector of the serial communication interface to transmit the access information and the identification information when attached to said printing apparatus.

12. An information service system comprising:

an information service server that manages a home page, which provides information about an image forming cartridge and a printing apparatus using said image forming cartridge;

a printing system including an image forming cartridge having a nonvolatile memory that stores access information for gaining access to the home page, which provides information about an image forming cartridge and a printing apparatus using said image forming cartridge and identification information for identifying said image forming cartridge, identifying means for identifying said image forming cartridge as a genuine product based on the identification information, and access means, which is connected to an information service server that manages the home page via a network, for gaining access to the home page based on the access information when said image forming cartridge is identified as a genuine product; and a network for connecting said printing system and said information service server to each other.

13. The information service system according to claim 12, wherein said access means transmits the identification information of said image forming cartridge and that of a user so as to gain access to the home page, and said information service server includes a genuine product identifying section for identifying said image forming cartridge as a genuine product based on the received identification information, a member data transmission recording database, a distribution controller for checking whether or not the user is registered as a member in said member data transmission recording database based on the received identification information of the user when said image forming cartridge is identified as a genuine product by said genuine product identifying section and for requesting a printing system to transmit data for member registration when no member registration is made, and a registering section for performing processing for registration to said member data transmission recording database when receiving the data for member registration.

14. The information service system according to claim 13, wherein when said image forming cartridge is identified as a non-genuine product by said genuine product identifying section, said distribution controller records transmission on said member data transmission recording database as presence of a charge for information service and when said image forming cartridge is identified as a genuine product by said genuine product identifying section, said distribution controller records transmission thereon as absence of a charge for information service or presence of a reduced charge.

15. The information service system according to claim 13, wherein said access means transmits the identification information of said image forming cartridge to gain access to the home page, and requests an optimal image forming condition, which is conformable to identification information of said image forming cartridge, from said information service server, said distribution controller distributes an optimal image forming condition, which is conformable to identification information of said image forming cartridge, based on an image forming condition table when the image forming cartridge is identified as a genuine product by said genuine product identifying section, and said identifying means rewrites a content of the image forming condition stored in a memory built in said image forming cartridge to an image forming condition collected from the home page by a printer driver.

16. The information service system according to claim 13, further comprising an identification information table storage for storing an identification information table indicating the range of recognition as a genuine product in connection with manufacturer's serial number, date of manufacture, manufacturing factory, and authentication code to determine whether or not said image forming cartridge is a genuine product.

17. An information service server that manages a home page, which provides information about an image forming cartridge and a printing apparatus using said image forming cartridge, said information service server comprising:

a genuine product identifying section for identifying said image forming cartridge as a genuine product based on identification information of said image forming cartridge received from a printing system that desires to gain access to the home page;

a member data transmission recording database for recording data of a registered member and information service provided to said registered member;

a distribution controller for checking whether or not a user is registered as a member in said member data transmission recording database based on the received identification information of the user when said image forming cartridge is identified as a genuine product by said genuine product identifying section, and for requesting transmission of data for member registration when no member registration is made; and a registering section for performing processing for registering the user in said member data transmission recording database when receiving the data for member registration.

18. The information service server according to claim 17, wherein when said image forming cartridge is identified as a non-genuine product by said genuine product identifying section, said distribution controller records transmission on said member data transmission recording database as presence of a charge for information service, and when said image forming cartridge is identified as a genuine product by said genuine product identifying section, said distribution controller records transmission thereon as absence of a charge for information service or presence of a reduced charge.

19. The information service server according to claim 17, wherein said distribution controller distributes an optimal image forming condition, which is conformable to identification information of said image forming cartridge, based on an image forming condition table when said image forming cartridge is identified as a genuine product by said genuine product identifying section.

20. The information service server according to claim 17, further comprising an identification information table storage for storing an identification information table indicating the range of recognition as a genuine product in connection with manufacturer's serial number, date of manufacture, manufacturing factory, and authentication code to determine whether or not said image forming cartridge is a genuine product.

* * * * *